US005427375A

United States Patent [19]

Breckwoldt

[11] Patent Number: 5,427,375

[45] Date of Patent: Jun. 27, 1995

[54] THREE-DIMENSIONAL PLAYING DEVICE

[76] Inventor: Thies Breckwoldt, c/o Bohm Hermann-Burgdorf-Str. 93, D-21244 Buchholz, Germany

[21] Appl. No.: 211,836

[22] PCT Filed: Sep. 8, 1993

[86] PCT No.: PCT/EP93/02423

§ 371 Date: Apr. 29, 1994

§ 102(e) Date: Apr. 29, 1994

[87] PCT Pub. No.: WO94/05386

PCT Pub. Date: Mar. 17, 1994

[30] Foreign Application Priority Data

Sep. 10, 1992 [DE] Germany ..... 42 30 540.3

[51] Int. Cl.[6] ..... A63F 9/08

[52] U.S. Cl. ..... 273/153 S; 273/146

[58] Field of Search ..... 273/153 S, 156, 146

[56] References Cited

U.S. PATENT DOCUMENTS

| | | | |
|---|---|---|---|
| 3,771,795 | 11/1973 | Flanigen | 273/157 R |
| 3,845,959 | 11/1974 | Kosarek . | |
| 4,424,971 | 1/1984 | Clark | 273/153 S |
| 4,432,548 | 2/1984 | Kassan | 273/153 S |
| 4,494,756 | 1/1985 | Winer | 273/156 |

FOREIGN PATENT DOCUMENTS

| | | | |
|---|---|---|---|
| 8110468 | 4/1981 | Germany . | |
| 8112064 | 4/1981 | Germany . | |
| 8901612 | 2/1989 | Germany . | |
| 4106826 | 3/1991 | Germany . | |
| 2177929 | 2/1987 | United Kingdom | 273/153 S |
| 2246961 | 2/1992 | United Kingdom | 273/153 S |
| WO89/07968 | 9/1989 | WIPO . | |
| 2019339 | 11/1992 | WIPO | 273/153 S |

*Primary Examiner*—Vincent Millin
*Assistant Examiner*—William M. Pierce
*Attorney, Agent, or Firm*—Lane, Aitken & McCann

[57] ABSTRACT

A three-dimensional playing device has a cubic frame having nine windows per face of the cube arranged in three rows and three columns and 26 ($3\times9-1=26$) dice arranged inside the cubic frame, movable in three dimensions and whose sides bear color indicia, specifically, six equal dice in each of which three sides sharing a first common corner each has a first color thereon and another three sides sharing a second common corner each has a second color thereon; two equal dice in each of which three sides sharing a common corner each has the first color thereon, and, of their remaining sides, one side has the second color thereon and two sides have a third color thereon; two equal dice in each of which three sides sharing a common corner each has the second color thereon, and of their remaining sides, one side has the first color thereon and two sides have the third color thereon; four equal dice in each of which three sides sharing a common corner each has the third color thereon, and, of their remaining sides, two sides have the first color thereon and one side has the second color thereon; four equal dice in each of which three sides sharing a common corner each has the third color thereon, and, of their remaining sides, one side has the first color thereon and two sides have the second color thereon, and each of the remaining eight dice has all three colors thereon, two sides of each color.

2 Claims, 3 Drawing Sheets

THREE-DIMENSIONAL PLAYING DEVICE

The invention relates to a three-dimensional playing device, comprising a cubic frame having nine windows per face of the cube arranged in three rows and three columns and 26 ($3\times9-1=26$) dice arranged inside the cubic frame, movable in three dimensions and whose faces bear markings, in particular colours.

BACKGROUND OF THE INVENTION

Three-dimensional translation toys are already known (WO 89/07968, publicated Sep. 8, 1989, or U.S. Pat. No. 3,845,959 respectively), in which $3\times9-1=26$ dice, held together by a frame, are movable in three dimensions. All the dice can be brought into 27 different spatial positions by means of these movements. It is the purpose of the game to achieve certain arrangements of the dice. The movement of the dice is made possible by a so-called void space. The void space can be moved to the inner position by means of a mechanism, so that the playing device takes the shape of a symmetrical body. In the case of the already known translation toys, the dice bear markings, e.g. the faces of the dice may have been provided with different colours. It has however not been stated exactly how these colours are to be provided.

A three-dimensional playing device (DE 4 106 826 A 1) comprising a cubic frame and 26 blocks is already known. These 26 blocks, each provided with a number or part of a picture, have been placed within the cubic frame and are movable within this cubic frame either by hand or by means of a magnetic block. Furthermore, all six sides of a die in this playing device have been provided with the same number, namely the numbers 1 to 27, with the number 14 missing. The dice should then be arranged spatially in such a way that so-called magic number squares are created in three planes, i.e. one definite position within this cubic frame has to be found for each of the 26 dice. This is also valid if the sides of the dice have been provided with a picture.

SUMMARY OF THE INVENTION

It is however the purpose of the present invention to provide the sides of the dice of the playing device with markings of the kind mentioned above, especially with three different colours, in such a way that all the dice show the first colour when in the first position, all dice show the second colour when in the second position and all dice—with the exception of one die per frame side—show the third colour when in the third position.

This is achieved by means of the markings of the dice, specifically, six equal dice in each of which three sides sharing a first common corner each has a first colour thereon and another three sides sharing a second common corner each has a second colour thereon; two equal dice in each of which three sides sharing a common corner each has the first colour thereon, and, of their remaining sides, one side has the second colour thereon and two sides have a third colour thereon; two equal dice in each of which three sides sharing a common corner each has the second colour thereon, and of their remaining sides, one side has the first colour thereon and two sides have the third colour thereon; four equal dice in each of which three sides sharing a common corner each has the third colour thereon, and, of their remaining sides, two sides have the first colour thereon and one side has the second colour thereon; four equal dice in each of which three sides sharing a common corner each has the third colour thereon, and, of their remaining sides, one side has the first colour thereon and two sides have the second colour thereon; and each of the remaining eight dice has all three colours thereon, two sides of each colour.

The invention has been described in relation to dice. It is however not definitely necessary to use and compose dice in the way described above; individual elements having other shapes are also conceivable, such as those having a rhomboid-shaped base or a base in the shape of any other geometrical figure.

In the case of the three-dimensional playing device according to the invention, certain arrangements of the dice, e.g. when they have been provided with the colours green, red and yellow, can actually bring about the impression that the dice within the cubic frame are all green, or all red, respectively.

For the third colour, one side of one die has a different colour, e.g. if yellow was chosen as the third colour, one die of each frame side is green. In this case, there is also the possibility to freely choose which of the dice is to have a different colour; preferably the centre die, i.e. the die not bordering one of the corners or one of the edges of the cubic frame, is to be used.

If $3\times3$ dice are arranged in three planes to form a large cube within a cubic frame, it is necessary to use 27 dice. If those dice are to be moved within the interior of the cubic frame, a void space has to remain, and this is chosen as the core, i.e. the centre of the cubic frame, in relation to the invention.

Each individual die has six sides, and according to the position of the die within the cubic frame described above, either three, two or only one side are visible. Each corner die has three visible sides sharing a common corner. The dice positioned at the edges have two visible sides sharing a common edge. The centre die only has a single visible side.

The total surface of a cubic frame with a void core amounts to $3\times3\times6=54$ faces. The total surface of all 26 dice amounts to $6\times26=156$ faces. The remaining 102 sides ($156-54=102$) of the dice are not visible from the outside.

Therefore, if all visible sides of the 26 dice are to have the same colour, 54 sides have to be of that colour, i.e. three sides each sharing a common corner of the eight corner dice are to be marked with that colour, two sides each of the twelve dice positioned at the edges are to be marked with that colour, and only one side each of the six centre dice is to be marked with that colour, i.e. $8\times3+12\times2+1\times6=54$.

If the already marked dice are moved to a second position in which all sides are to show another colour, the above mentioned method applies once more. Thus, $2\times54$ sides of the altogether 156 available sides are now provided with two colours, so that now there are less that 54 sides left for the third colour. Only 48 sides can be marked with the third colour, so on each side of the cubic frame one die shows another colour, either the first or the second colour.

It is obvious that also different pictures may be composed by means of dice provided with markings according to the invention, and not just all sides of the cube having the same colour. Combinations of patterns may be composed in which e.g. the eight outer dice of one side of the cubic frame are provided with the same colour and the centre die is of a different colour, or cross patterns and other arrangements may be composed as well.

There are altogether $2\times10^{26}$ possible arrangements for the 26 dice. In the case of three colours, there are approximately 20,000 colour combinations per side and altogether $0.6\times10^{26}$ colour combinations.

There are varying levels of difficulty when composing the above mentioned patterns. The difficulty level of the exclusively red or green cube is 1, whereas the cube consisting of red corners, green edges, and an orange centre on all sides would have difficulty level 17.

DETAILED DESCRIPTION OF THE PREFERRED EMBODIMENT

Figure 1:
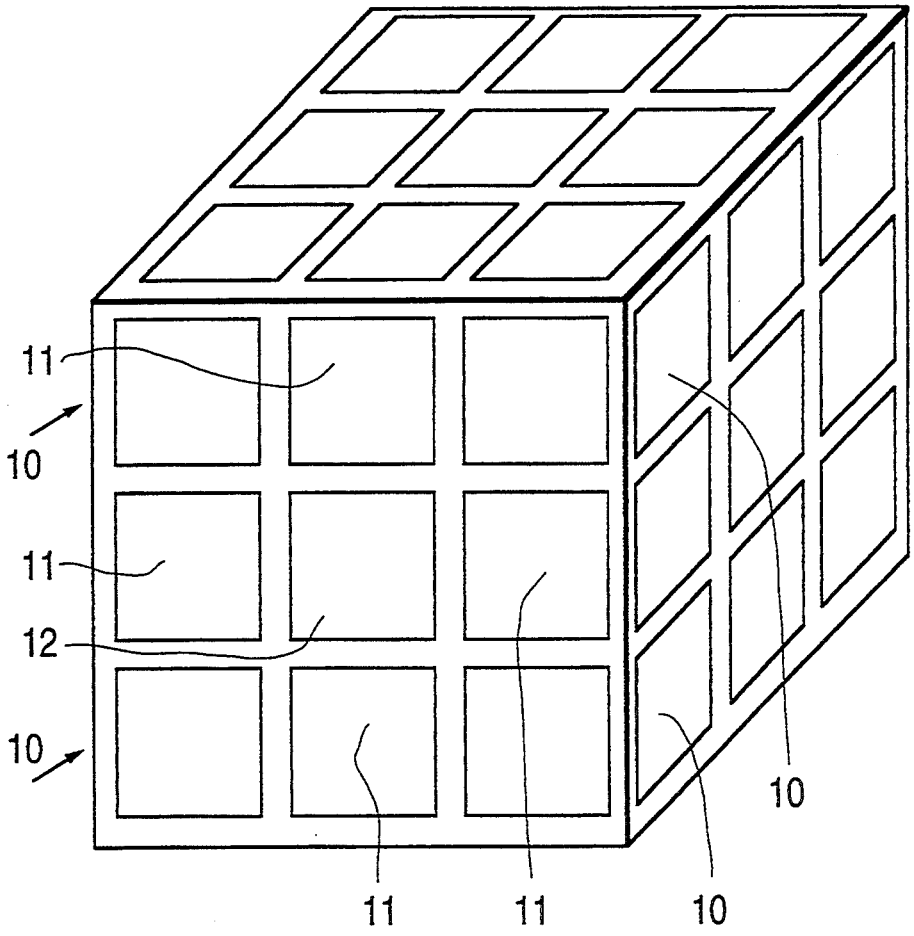
FIG. 1 is a representation of the playing device according to the invention.
Figure 2:
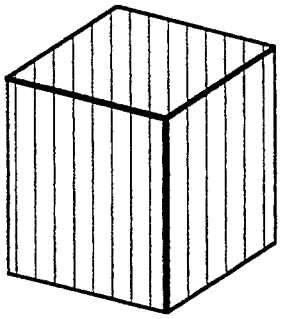
FIG. 2 is a front perspective view of a first type of die used in the playing device according to the present invention.
Figure 3:
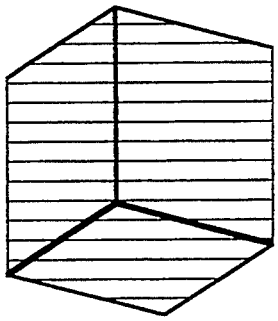
FIG. 3 is a rear perspective view of the die of FIG. 2.
Figure 4:
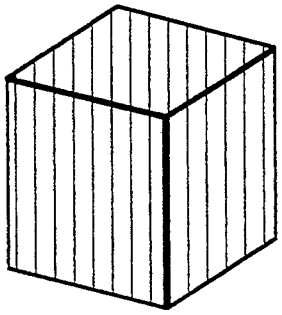
FIG. 4 is a front perspective view of a second type of die used in the playing device according to the present invention.
Figure 5:
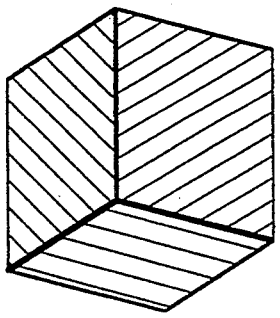
FIG. 5 is a rear perspective view of the die of FIG. 4.
Figure 6:
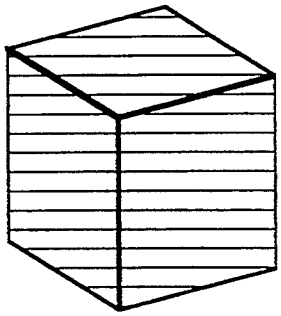
FIG. 6 is a front perspective view of a third type of die used in the playing device according to the present invention.
Figure 7:
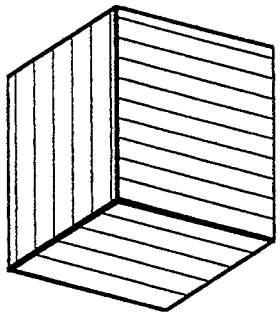
FIG. 7 is a rear perspective view of the die of FIG. 6.
Figure 8:
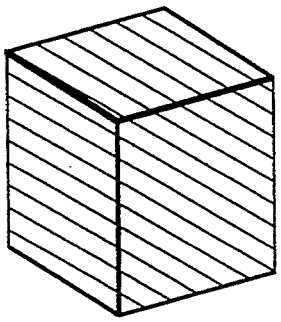
FIG. 8 is a front perspective view of a fourth type of die used in the playing device according to the present invention.
Figure 9:
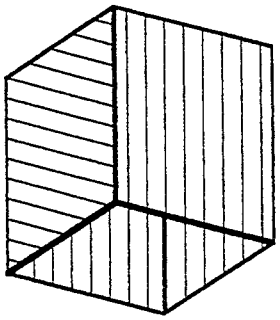
FIG. 9 is a rear perspective view of the die of FIG. 8.
Figure 10:
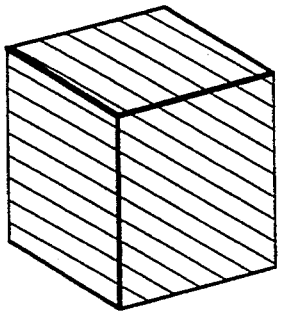
FIG. 10 is a front perspective view of a fifth type of die used in the playing device according to the present invention.
Figure 11:
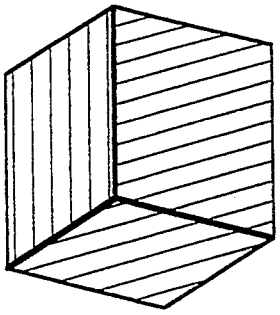
FIG. 11 is a rear perspective view of the die of FIG. 10.
Figure 12:
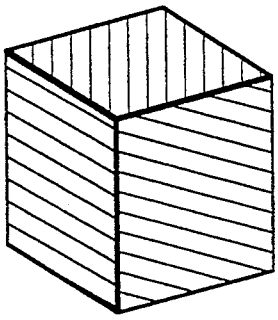
FIG. 12 is a front perspective view of a sixth type of die used in the playing device according to the present invention.
Figure 13:
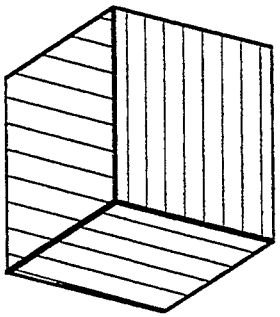
FIG. 13 is a rear perspective view of the die of FIG. 12.

FIG. 1 shows a cubic frame with three sides being visible; Those sides not visible are formed in a corresponding manner with square windows, although the shape of the windows is not important in relation to the invention.

The individual dice are visible behind the recesses of the frame:

10 designates the corner dice having three visible sides. 11 designates the so-called edge dice having two visible sides. 12 designates the centre dice having only one visible side.

FIG. 1 illustrates that each die may take one of 27 positions since each die is movable in three dimensions. This means that a die has either one, two, or even three visible sides, according to its position, and the remaining sides are not visible. In any case, each die is movable so that alternatively one or another of its sides is visible, and altogether all sides can be made visible.

FIGS. 2, 4, 6, 8, 10 and 12 show three of the six sides of each of the respective types of dice used in the playing device according to the present invention. FIGS. 3, 5, 7, 9, 11 and 13, respectively, show the three sides of each type of die not shown in FIGS. 2, 4, 6, 8, 10 and 12. In each of FIGS. 2–13, vertical shading lines are used to represent a first indicia, such as the colour green; horizontal shading lines are used to indicate a second indicia, such as the colour red; and sloped shading lines are used to indicate a third indicia, such as the colour yellow.

I claim:

1. A three-dimensional playing device comprising a cubic frame having nine windows per face of the cube arranged in three rows and three columns and 26 dice arranged inside the cubic frame, the dice being movable in three dimensions, characterized by provision of the following dice, each of which has corners and six sides, each of the sides sharing common corners with some of the other sides, and each of the sides bearing indicia:

six equal dice in each of which three sides sharing a first common corner each has a first indicia thereon and another three sides sharing a second common corner each has a second indicia thereon;

two equal dice in each of which three sides sharing a common corner each has the first indicia thereon, and, of their remaining sides, one side has the second indicia thereon and two sides have a third indicia thereon;

two equal dice in each of which three sides sharing a common corner each has the second indicia thereon, and of their remaining sides, one side has the first indicia thereon and two sides have the third indicia thereon;

four equal dice in each of which three sides sharing a common corner each has the third indicia thereon, and, of their remaining sides, two sides have the first indicia thereon and one side has the second indicia thereon;

four equal dice in each of which three sides sharing a common corner each has the third indicia thereon, and, of their remaining sides, one side has the first indicia thereon and two sides have the second indicia thereon; and each of the remaining eight dice has all three indicia thereon, two sides of each indicia.

2. The three-dimensional playing device of claim 1, wherein the first, second and third indicia are colours.

* * * * *